US005176282A

United States Patent [19]

Rapaz

[11] Patent Number: 5,176,282

[45] Date of Patent: Jan. 5, 1993

[54] DINNER PLATE

[76] Inventor: Antonio M. R. Rapaz, 4601 Cleveland Ave., Chilliwack, B.C. V2P 2V8, Canada

[21] Appl. No.: 744,975

[22] Filed: Aug. 14, 1991

[51] Int. Cl.[5] ..... B65D 25/04

[52] U.S. Cl. ..... 220/574; 220/501; 220/575

[58] Field of Search ..... 220/572, 574, 575, 501, 220/556; 99/425

[56] References Cited

U.S. PATENT DOCUMENTS

| | | | |
|---|---|---|---|
| D. 137,961 | 5/1944 | Kapner et al. | 99/425 |
| 1,685,116 | 9/1928 | Barchoff | 220/575 |
| 1,707,532 | 4/1929 | Moon . | |
| 1,756,963 | 5/1930 | Ware | 220/575 |
| 2,012,520 | 8/1935 | Rogers | 99/425 |
| 2,211,030 | 8/1940 | Rutenber | 99/425 |
| 2,579,258 | 12/1951 | Heckert . | |
| 2,849,949 | 9/1958 | Trachtman | 99/425 |
| 2,875,683 | 3/1959 | Burns . | |
| 3,236,403 | 2/1966 | Steinberg . | |
| 3,385,357 | 5/1968 | Burg | 99/425 |
| 3,407,723 | 10/1968 | Varkala . | |
| 3,427,957 | 2/1969 | O'Reilly . | |
| 3,664,256 | 5/1972 | Peirce | 99/425 |
| 4,462,388 | 7/1984 | Bohl et al. | 99/425 |

FOREIGN PATENT DOCUMENTS

| | | | |
|---|---|---|---|
| 811142 | 8/1951 | Fed. Rep. of Germany | 220/501 |
| 16668 | of 1888 | United Kingdom | 220/575 |
| 117379 | 7/1918 | United Kingdom | 220/575 |
| 562076 | 6/1944 | United Kingdom | 220/575 |

*Primary Examiner*—Stephen Marcus
*Assistant Examiner*—S. Castellano
*Attorney, Agent, or Firm*—Barrigar & Oyen

[57] ABSTRACT

A dinner plate for serving, consuming and storing greasy foods, such as bacon, sausages or steaks. The plate has a central surface and a food-supporting plane raised above a portion of the central surface and having a plurality of channels for receiving greasy juices released from the food. The central surface is preferably inclined to facilitate drainage of such greasy juices to a lower side of the plate.

16 Claims, 2 Drawing Sheets

DINNER PLATE

FIELD OF THE INVENTION

This application pertains to a dinner plate for serving, consuming and storing greasy foods, such as bacon, sausages or steaks. The plate has a central surface and a food-supporting plane raised above the central surface and having a plurality of channels for receiving greasy juices released from the food. The central surface is preferably inclined to facilitate drainage of such greasy juices to a lower side of the plate.

BACKGROUND OF THE INVENTION

Various pans and trays are known in the prior art which are designed to facilitate drainage of grease and juices generated during cooking of fatty food. For example, U.S. Pat. No. 2,579,258 which issued to Heckert on Dec., 18, 1951, relates to a grill-spatula assembly primarily designed for cooking bacon and eggs. The Heckert device includes an inclined bottom surface which feeds into a flat lower compartment having corner drain points. In use, strips of bacon are placed on the inclined surface so that grease will run into the flat compartment where the eggs are cooked.

U.S. Pat. No. 1,707,532, which issued to Moon on Apr. 2, 1929, discloses a frying pan which is also designed for cooking bacon and eggs. The frying pan includes a flat bottom portion and a corrugated portion formed from a plurality of raised ribs. The ribs are arranged in parallel orientation so as to provide drainage channels communicating with the flat portion.

U.S. Pat. No. 3,236,403 which issued to Steinberg on Feb. 22, 1966, discloses a food storage and cooking tray including means for elevating one end of the tray, thus creating a sloped bottom surface.

The above-noted patents relate primarily to cooking or food storage pans and trays rather than dinner plates for serving and consuming food. The need has therefore arisen for a dinner plate for facilitating drainage of grease released during consumption of fatty foods.

SUMMARY OF THE INVENTION

In accordance with the invention there is provided a dinner plate having a central surface, a base adapted for resting on the surface of a table, a raised perimeter extending around the central surface, and a food-supporting plane raised above the central surface and comprising a plurality of channels adapted to permit the drainage of liquids from the food-supporting plane.

The food-supporting plane may include a plurality of ribs projecting upwardly from the central surface. Advantageously, the ribs have upper surfaces which are substantially co-planar.

Preferably, the central surface is inclined relative to the table surface from an upper side to a lower side when the base is resting on the table. The ribs are arranged to permit the flow of liquids from the food-supporting plane to the lower side of the central surface.

The dinner plate may also include an upstanding wall located adjacent the central surface lower side and extending above the plane of the food-supporting plane. The upstanding wall is adapted to permit the flow of liquids.

Preferably, the dinner plate is generally circular or oval-shaped and the upstanding wall forms a chord across the central surface such that the central surface upper side has a substantially greater surface area than the central surface lower side. The upstanding wall may have a plurality of spaced notches formed therein to facilitate drainage of liquids to the central surface lower side.

The food-supporting plane is preferably located above a central portion of the central surface adjacent the upstanding wall. The ribs may extend in parallel relation substantially perpendicular to the upstanding wall such that the channels comprise troughs defined between adjacent ribs.

The central surface also preferably includes a non-ribbed portion at the upper side thereof adjacent the food-supporting plane which is in communication with at least one of the channels.

BRIEF DESCRIPTION OF THE DRAWINGS

In the accompanying drawings which illustrate two preferred embodiments of the invention.

DETAILED DESCRIPTION OF THE PREFERRED EMBODIMENT

It is well known that high fat diets, especially diets that are high in saturated fats, tend to raise blood cholesterol levels. Elevated cholesterol levels have in turn been associated with increased risk of atherosclerosis which may eventually result in heart attacks or strokes. Accordingly, there is an increasing awareness of the importance of reducing dietary fat intake by modifying food preparation and cooking techniques. However, heretofore it has not been fully appreciated that significant reductions in fat intake may be achieved by modifying the design of dinner plates upon which food is typically consumed.

Figure 1:
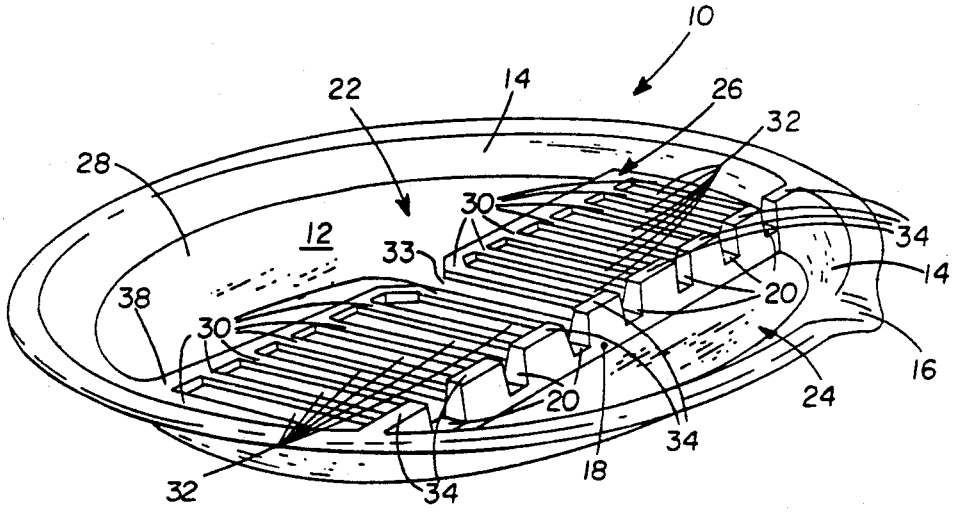
FIG. 1 is an isometric view of a plate constructed in accordance with the invention.

As illustrated in FIG. 1, the applicant has designed an improved dinner plate 10 for enhancing drainage of fatty grease released during consumption of a meal. Independent testing conducted by the British Columbia Research Corporation indicates that statistically significant reductions in fat intake may be achieved by consuming fatty foods on plate 10 rather than a conventional flat-bottomed dinner plate. For example, consumable fat levels were reduced on the order of 10% by serving rib steaks on plate 10 rather than a regular dinner plate.

Figure 2:
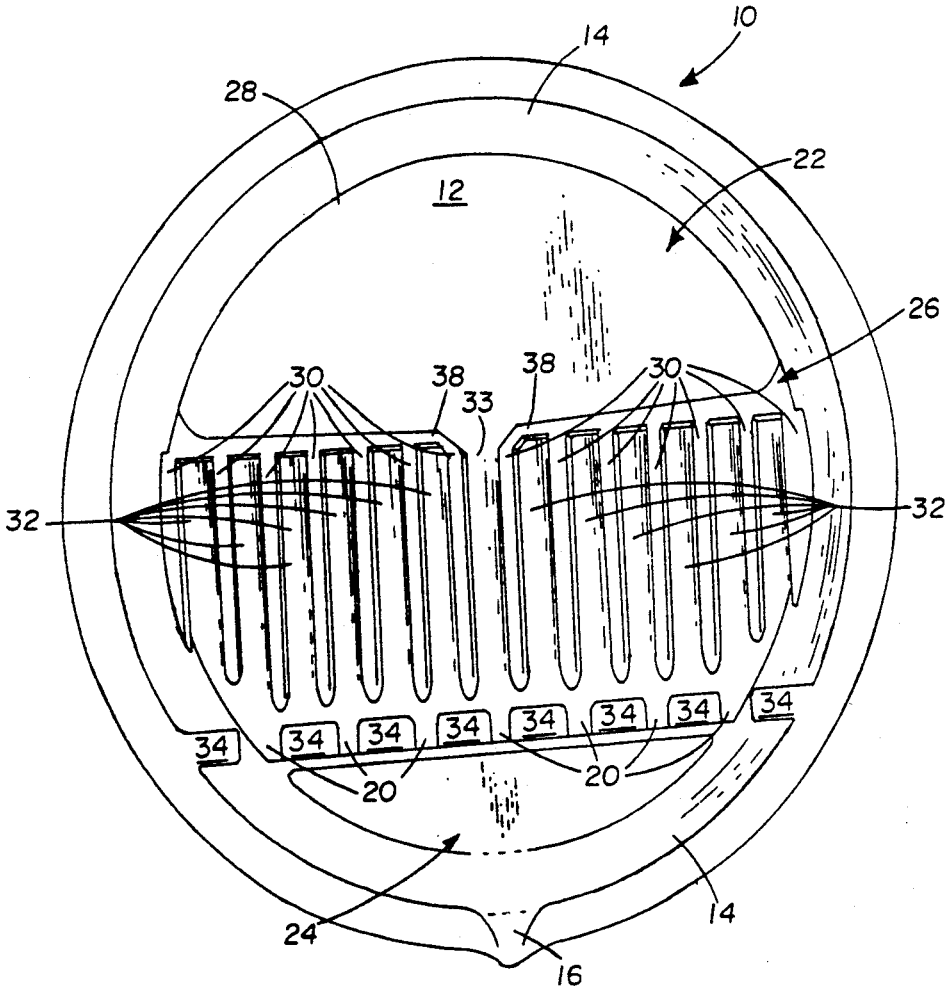
FIG. 2 is a top, plan view of the plate of FIG. 1.
Figure 3:
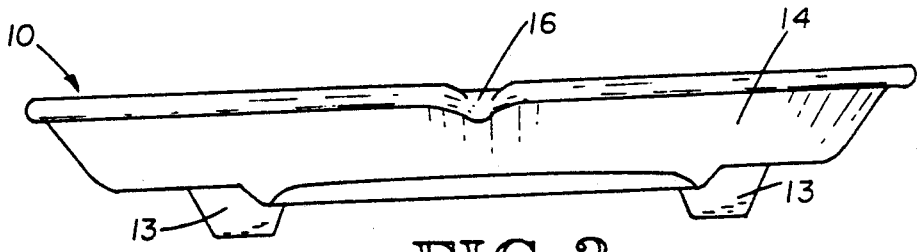
FIG. 3 is a front, elevational view of the plate of FIG. 1.

As shown in FIGS. 1 and 2, plate 10 is preferably circular or oval-shaped and includes a central surface 12. Surface 12 is surrounded by a raised perimeter 14 which is preferably sloped toward surface 12 and is of greater height than a conventional plate sidewall. An outwardly protruding lip 16 is formed in perimeter 14 at one circumferential position to facilitate removal of grease from plate 10 as described in further detail below.

Figure 4:
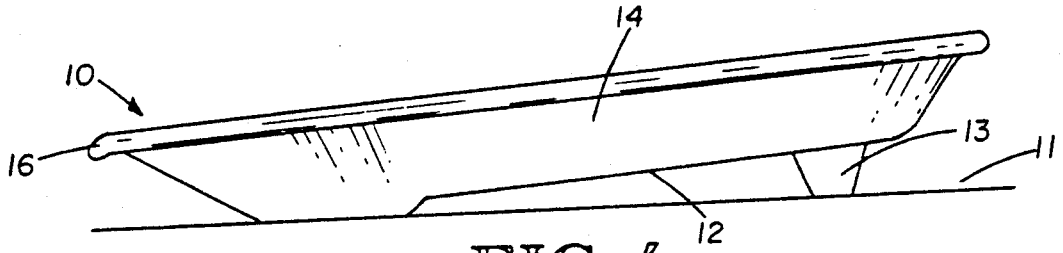
FIG. 4 is a side, elevational view of the plate of FIG. 1.
Figure 5:
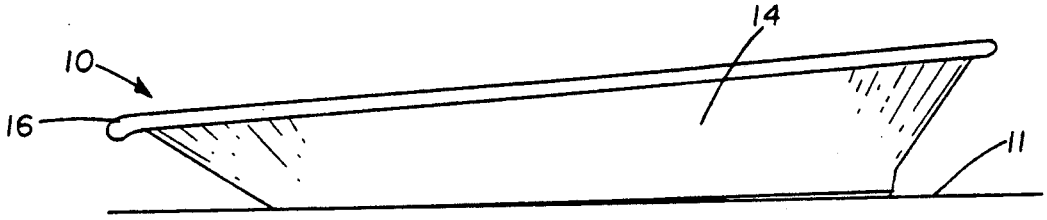
FIG. 5 is side, elevational view of an alternative embodiment of the invention.
Figure 6:
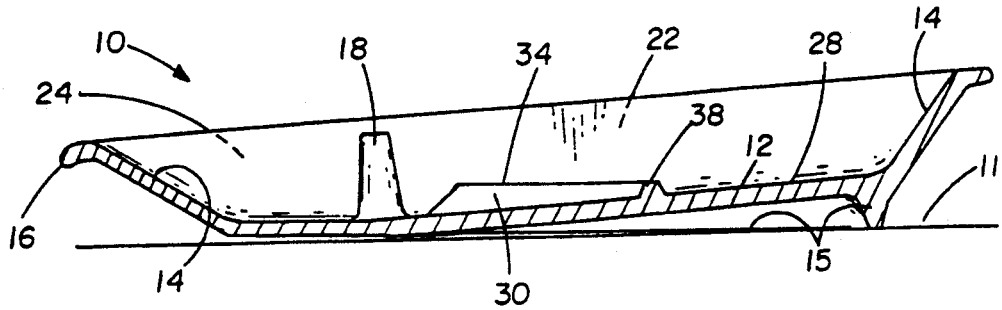
FIG. 6 is a longitudinal sectional view of the plate of FIG. 5.

Plate 10 includes means for elevating an end of central surface 12 above a flat support surface 11, such as a table (FIG. 4). For example, plate 10 may comprise a pair of spaced-apart squat legs 13 projecting downwardly from central surface 12. Alternatively, as best shown in FIG. 6, sidewall 14 may include a base 15 extending beneath the plane of surface 12 for supporting surface 12 in an inclined position relative to support surface 11.

Plate 10 also includes an upstanding wall 18 which forms a chord across plate 10, thus dividing surface 12 into a larger first compartment 22 and a smaller second compartment 24 proximate lip 16 (FIGS. 1 and 2). Since surface 12 is at least partially inclined relative to support surface 11, fluid released from food placed within first compartment 22, such as fatty juices, drains by gravity into second compartment 24, which acts as a grease collection sump. To this end, wall 18 is provided with a series of regularly spaced notches 20 to enable flow of fluid into second compartment 24.

Plate 10 further includes a raised food-supporting plane 26 located in first compartment 22 adjacent wall 18 (FIGS. 1 and 2). Plane 26 comprises a plurality of raised, substantially parallel ribs 30 which extend at right angles relative to wall 19. A series of troughs 32 are defined between adjacent ribs 30. Ribs 30 have flat upper surfaces 34 which extend in a substantially horizontal plane relative to support surface 11 (FIG. 6). Rib upper surfaces 30 act as a platform for supporting greasy meats, such as bacon, sausages, steaks and the like. The grease released when such foods are consumed on plate 10 is collected in troughs 32 and is channelled into second compartment 24. The ends of ribs 30 proximate wall 18 are preferably tapered to merge smoothly with surface 12 adjacent wall 18 (FIG. 6).

Wall 18 acts as a barrier preventing meat placed on plane 26 from inadvertently sliding into second compartment 24. The inventor anticipates that wall 18 may also serve as a reference landmark for blind people to assist in identifying where various food items are located on plate 10. Similarly, handicapped individuals with impaired motor skills may find it easier to cut meat or other food positioned on plane 26 and buttressed against wall 18. In this regard wall notches 20 may serve as knife guide slots.

As shown in FIGS. 1 and 2, surface 12 preferably includes a non-ribbed portion 28 in first compartment 22 adjacent plane 26. Non-ribbed portion 28 is adapted for receiving relatively non-greasy foods, such as salads or fruits. Due to the incline of surface 12 referred to above, food placed in non-ribbed portion 28 is located upstream from plane 26 and hence such food will not be fouled by grease released from meat placed on plane 26.

The ends of ribs 30 remote from wall 18 are preferably joined to define a transverse raised segment 38 extending across surface 12. Segment 38 has a central interruption to ensure that non-ribbed portion 28 is in communication with at least a central trough 33 (FIG. 2). This ensures that any fluid released from food placed on non-ribbed portion 28 will also be channelled through central trough 33 into second compartment 24.

As shown best in FIG. 2, raised segment 38 may be slightly angled to facilitate fluid flow into central trough 33. To this end, segment 38 may also be rounded where it merges with sidewall 14.

In the embodiment shown in the drawings, non-ribbed portion 28 is a smooth, planar surface. In an alternative embodiment (not shown), non-ribbed portion 28 may comprise opposed planar surfaces or a shallow concave surface which is uniformly inclined toward central trough 33. That is, non-ribbed portion 28 may be laterally inclined (i.e. toward central trough 33) in addition to being longitudinally inclined (i.e. toward second compartment 24) to facilitate fluid drainage as discussed above.

Grease collected in second compartment 24 may be conveniently poured through lip 16 into another container for disposal or measurement. If desired, second compartment 24 may also be used as a sump for gravy, dip, sauces and the like thereby preventing such fluids from migrating over the entire plate as is often the case with regular flat-bottomed dinner plates.

Plate 10 is preferably constructed from non-metallic material suitable for use in microwave ovens and dishwashers. By using plate 10 as both a cooking and eating utensil less clean-up is required after a meal. The storage advantages of plate 10 should also be readily apparent. When leftovers are placed within plate first compartment 22 and are refrigerated, excess grease will drain into compartment 24 rather than congealing around the stored food.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A dinner plate comprising:

(a) a base adapted for resting on the surface of a table;

(b) an upwardly-facing central surface supported by said base at an incline relative to said table surface when said base is resting on said table;

(c) a raised perimeter extending around said central surface;

(d) a food-retaining barrier projecting upwardly from said central surface and linearly extending across said plate in a direction perpendicular to the direction of inclination of said central surface, said barrier thereby dividing said central surface into a lower liquid-retaining portion and an upper food retaining portion;

and wherein said upper portion of said central surface further comprises a first food holding and draining area closest to said barrier and a second food holding area of said central surface furthest from said barrier, said first food holding and draining area comprising a food-supporting pedestal raised above said central surface and comprising a plurality of channels adapted to permit the drainage of liquids from said pedestal past said barrier into said plate lower portion.

2. The dinner plate as defined in claim 1, wherein said food-supporting pedestal comprises a plurality of spaced ribs projecting upwardly from said central surface, said ribs having upper surfaces which are substantially co-planar.

3. The dinner plate as defined in claim 1, wherein said first food holding and draining portion is provided with means for draining liquids from said second food holding portion into said lower liquid-retaining portion.

4. The dinner plate of claim 2, wherein said barrier is adapted to permit the flow of liquids into said lower portion.

5. The dinner plate of claim 4, wherein said plate is generally circular in shape and wherein said barrier forms a chord across said central surface such that said upper portion is substantially larger than said lower portion.

6. The dinner plate of claim 5, wherein said barrier has a plurality of spaced notches formed therein to facilitate drainage of liquid into said lower portion.

7. The dinner plate as defined in claim 4, wherein said plate is generally oval-shaped and wherein said barrier forms a chord across said central surface such that said plate upper portion is substantially larger than said plate lower portion.

8. The dinner plate of claim 2, wherein said ribs extend in parallel relation substantially perpendicular to said barrier.

9. The dinner plate of claim 8, wherein said channels comprise troughs defined between said ribs.

10. The dinner plate of claim 9, wherein said second food holding area comprises a non-ribbed portion adjacent said food-supporting pedestal, wherein said non-ribbed portion is in communication with at least one of said channels.

11. The dinner plate of claim 10, wherein the ends of said ribs remote from said barrier are joined together to define a raised segment projecting upwardly from said central surface, wherein said raised segment is interrupted at a central portion thereof such that said non-ribbed portion is in communication with a centrally located channel.

12. The dinner plate of claim 2, wherein said rib upper surfaces extend in a substantially horizontal plane relative to said table surface when said base is resting on said table.

13. The dinner plate of claim 1, further comprising an outwardly protruding lip formed in said perimeter adjacent said lower portion to facilitate removal of liquids collected within said plate.

14. The dinner plate of claim 12, wherein said barrier extends above the plane of said food-supporting pedestal.

15. A dinner plate comprising a central surface, a base adapted for resting on the surface of a table, a raised perimeter extending around said central surface, and a food-supporting plane raised above said central surface and comprising a plurality of channels adapted to permit the drainage of liquids from said food-supporting plane, wherein said food-supporting plane comprises a plurality of ribs projecting upwardly from said central surface;

wherein said ribs have upper surfaces which are substantially coplanar;

wherein said central surface is inclined relative to said table surface from an upper side to a lower side when said base is resting on said table;

wherein said ribs are arranged to permit the flow of liquid from said food-supporting plans to said central surface lower side;

further comprising an upstanding wall located adjacent said central surface lower side and extending above said food-supporting plane;

wherein said upstanding wall is adapted to permit the flow of liquids;

wherein said plate is generally circular and wherein said upstanding wall forms a chord across said central surface such that said central surface upper side has a substantially greater surface area then said central surface lower side;

wherein said upstanding wall has a plurality of spaced notches formed therein to facilitate drainage of liquid to said central surface lower side;

wherein said food-supporting plane is located above a central portion of said central surface adjacent said upstanding wall;

wherein said ribs extend in parallel relation substantially perpendicular to said upstanding wall;

wherein said channels comprise troughs defined between said ribs;

wherein said central surface upper side comprises a non-ribbed portion adjacent said food-supporting plane, wherein said non-ribbed portion is in communication with at least one of said channels;

wherein the ends of said ribs remote from said upstanding wall are joined together to define a raised segment projecting upwardly from said central surface, wherein said raised segment is interrupted at a central portion thereof such that said non-ribbed portion is in communication with a centrally located channel; and wherein said raised segment is angled toward said central trough to facilitate drainage of said liquid thereinto.

16. The dinner plate of claim 15, wherein said non-ribbed portion is uniformly inclined toward said central trough to facilitate drainage of liquid thereinto.

* * * * *

UNITED STATES PATENT AND TRADEMARK OFFICE

CERTIFICATE OF CORRECTION

PATENT NO. : 5,176,282

DATED : January 5, 1993

INVENTOR(S) : Antonio M. R. Rapaz

It is certified that error appears in the above-identified patent and that said Letters Patent is hereby corrected as shown below:

In column six, claim 15, line seven, please delete "plans" and substitute therefor --plane--.

Signed and Sealed this

Twenty-eighth Day of December, 1993

*Attest:*

Bruce Lehman

BRUCE LEHMAN

*Attesting Officer*

*Commissioner of Patents and Trademarks*